US007181153B2

(12) United States Patent
Hensel et al.

(10) Patent No.: US 7,181,153 B2
(45) Date of Patent: Feb. 20, 2007

(54) APPARATUS FOR PRECISELY ADJUSTING THE POSITION OF WORK STATIONS IN A DOCUMENT PRINTER/COPIER

(75) Inventors: Donald S. Hensel, Rochester, NY (US); Christopher S. Garcia, Rochester, NY (US); D. Steven Kepner, Canandaigua, NY (US); Gary E. Nichols, Fairport, NY (US); Jeffrey R. Ulreich, Rochester, NY (US); Thomas S. Albrecht, Canandaigua, NY (US); Donald C. Buch, Rochester, NY (US); Charles W. Spehrley, Key Colony Beach, FL (US)

(73) Assignee: Eastman Kodak Company, Rochester, NY (US)

( * ) Notice: Subject to any disclaimer, the term of this patent is extended or adjusted under 35 U.S.C. 154(b) by 147 days.

(21) Appl. No.: 10/925,394

(22) Filed: Aug. 25, 2004

(65) Prior Publication Data

US 2005/0058478 A1 Mar. 17, 2005

Related U.S. Application Data

(60) Provisional application No. 60/498,564, filed on Aug. 28, 2003.

(51) Int. Cl.
*G03G 15/00* (2006.01)

(52) U.S. Cl. ..... 399/110; 399/117

(58) Field of Classification Search ..... 399/110, 399/117, 116, 111, 107, 113, 121, 302, 308, 399/372

See application file for complete search history.

(56) References Cited

U.S. PATENT DOCUMENTS

| | | | | |
|---|---|---|---|---|
| 5,212,520 | A * | 5/1993 | Toyofuku | 399/107 |
| 5,672,020 | A * | 9/1997 | Leonard et al. | 400/690.4 |
| 6,396,524 | B1 * | 5/2002 | Cooper et al. | 347/138 |
| 2001/0043819 | A1 * | 11/2001 | Taylor et al. | 399/121 |

* cited by examiner

*Primary Examiner*—Anthony H. Nguyen
(74) *Attorney, Agent, or Firm*—Lawrence P. Kessler

(57) ABSTRACT

Apparatus for precisely positioning one or more of the work stations of a document printer/copier relative to an internal drum, including a first member, attached to either a work station or the internal drum, having two sections, each section having a reference surface forming an angle therebetween, an actuator for changing the included angle between the first reference surface and second reference surface, thus enabling the included angle to be increased or decreased, and a second member having a reference surface that mates with the pair of reference surfaces, associated with the other of the work station or the internal drum, so as to accurately adjust the work station relative to the internal drum dependent upon the included angle of the first reference surface and second reference surface.

25 Claims, 8 Drawing Sheets

APPARATUS FOR PRECISELY ADJUSTING THE POSITION OF WORK STATIONS IN A DOCUMENT PRINTER/COPIER

CROSS REFERENCE TO RELATED APPLICATION

Reference is made to and priority claimed from U.S. Provisional Application Ser. No. 60/498,564, filed on Aug. 28, 2003, entitled APPARATUS FOR PRECISELY ADJUSTING THE POSITION OF WORK STATIONS IN A DOCUMENT PRINTER/COPIER.

FIELD OF THE INVENTION

This invention relates to the field of document printing/copying. More particularly, it relates to improvements in apparatus for precisely adjusting the position of various work stations of a document printer/copier, e.g., an electrophotographic printer/copier, relative to a reusable image-recording drum and/or image transfer drum.

BACKGROUND OF THE INVENTION

In electrophotographic printers and copiers, a toner image is formed on the surface of a photoconductive recording element. This image is commonly transferred, either directly or indirectly, to a receiver member (e.g., a sheet of paper), thereby enabling the recording element to be re-cycled through the image-forming process to make multiple prints/copies. Often, the physical form of the recording element is that of a drum having an outer surface of photoconductive material, either organic or inorganic. As the drum rotates, various work stations positioned about the drum periphery operate collectively to produce the toner image on the drum's photoconductive surface. These work stations usually comprise (i) a primary charging station for depositing a substantially uniform electrostatic charge on the drum's photoconductive surface; (ii) an exposure station for image-wise exposing the uniform charge to actinic radiation, thereby selectively dissipating the uniform charge to produce a charge image; and (iii) a development station for applying pigmented thermoplastic particles (toner) to the charge image to render it visible. In addition to these image-processing stations, other work stations, also positioned about the drum periphery, serve to transfer the toner image thus formed to an image-receiving member, e.g., a sheet of paper, or to an intermediate transfer drum from which it may be subsequently transferred to paper or the like, and to remove residual or non-transferred toner from the drum's photoconductive surface prior to recycling the drum through the image-forming process. When using an intermediate transfer drum, an additional toner-cleaning station is positioned adjacent the intermediate transfer drum, downstream from the second image-transfer station, to remove residual toner particles.

As will be appreciated, the consistent production of high quality images requires that certain positional relationships be established and maintained at all times between the above work stations and the photoconductive drum and intermediate transfer drum. For example, the spacing between the drum surface and the corona discharge wire(s) of the primary charging station must be maintained uniform across the drum surface in order to assure a uniform charge distribution across the drum surface. Further, the spacing between the drum surface and a toner-applying magnetic brush (or the like) must be kept within a very tight tolerance to consistently achieve a desired toner image density. The same holds true for spacing between the drum surface and the exposure station, which may be in the form of a solid-state print head or an optical projection system, in order to consistently form a sharply focused image on the drum's photosensitive surface. In some printer/copiers, such positioning of the work stations relative to the recording drum is maintained by using wheels that contact and rotate on the drum's outer surface. In other machines, reference rings or other structures are used to maintain the desired spacing. All such approaches require the use of precision parts, and are problematic from the standpoints of contamination and wear.

One example of positioning apparatus of the above type is disclosed in U.S. Pat. No. 5,089,846 to H. Tabuchi. In this disclosure, an exposure station in the form of an array of light-emitting diodes is supported for pivotal movement towards and away from a photoconductive drum. The positioning mechanism is mounted on the pivotal support and has an end that is adapted to contact and ride upon the outer edge of the photoconductive drum to thereby establish a desired spacing between the drum surface and the operative surfaces of the LED array. A second support pivotally mounted on the first support is spring biased to urge the first support towards engagement with the drum surface, and a cam surface mounted on the machine frame interacts with the second member to adjust its pivotal position. While intended to provide a simple and inexpensive approach to achieving high positional accuracy between the drum surface and the operative surface of the LED array, this approach is still subject to many of the aforementioned disadvantages, requiring the use of precision parts that eventually wear-out and introduce contamination.

An example of an improved positioning apparatus that is not subject to the aforementioned disadvantages is disclosed in U.S. Pat. No. 6,427,059 to Buch, et. al. Such apparatus includes a pair of drum-support members, each having associated reference surface features adapted to mate with complimentary reference surface features on the individual work stations. The placement of the reference surface features of the drum-support members are factory set to account for any idiosyncrasies (e.g., run-out) of a drum supported by such members. This apparatus does not, however, provide for adjustment of the position of the various work stations relative to photoconductor element at the user site if such adjustment should be determined to be required, for example, by observation of image quality deficiencies and/or the result of prescribed diagnostic procedures.

SUMMARY OF THE INVENTION

In view of the foregoing discussion, an object of this invention is to provide improved apparatus for precisely positioning one or more of the work stations of a document printer/copier relative to an internal drum, and furthermore, to provide precise adjustment of the position of one or more of such work stations at the user site. According to a preferred embodiment of the invention, apparatus is provided for precisely positioning the work stations of an electrophotographic document printer/copier relative to the outer surface of a rotating drum on which such work stations are required to carry out a process. The apparatus of the invention operates to precisely position an operative component of the work station substantially parallel to and spaced a desired distance from the surface of the rotating drum, and furthermore provides for adjustment of the position of such operative component relative to the rotating drum if such adjustment is required to correct an observed deficiency. The apparatus of the invention includes a first member, attached at a predetermined position with respect to either of the work station or the work piece, the member has first and second relatively movable sections, the first section has a first section surface and the second section has a second section surface at an angle to the first section surface, a second member, attached at a predetermined position with respect to the other of the work station or the work piece, the second member has a reference surface thereon the reference surface being positioned to engage the first section surface and the second section surface to position the work station relative to the work piece; and an actuator for changing the angular position of the first section surface relative to the second section surface, whereby when the reference surface engages the first and second section surfaces, the position of the work piece relative to the work station is accurately adjusted. As the width of the groove in the member attached to the work station is expanded or contracted by advancing or contracting the adjusting screw, the angle between the reference surfaces of the two sections of the member is increased or decreased. As a result, the spacing of the work station operative component from the photoconductive drum is decreased or increased when the reference surface of the drum support member is mated with the pair of grooved member reference surfaces.

BRIEF DESCRIPTION OF THE DRAWINGS

The invention and its technical advantageous effects will be better appreciated from the ensuing detailed description of a preferred embodiments, reference being made to the accompanying drawings in which like reference characters denote like or functionally similar parts, wherein.

DETAILED DESCRIPTION OF THE INVENTION

Figure 1A:
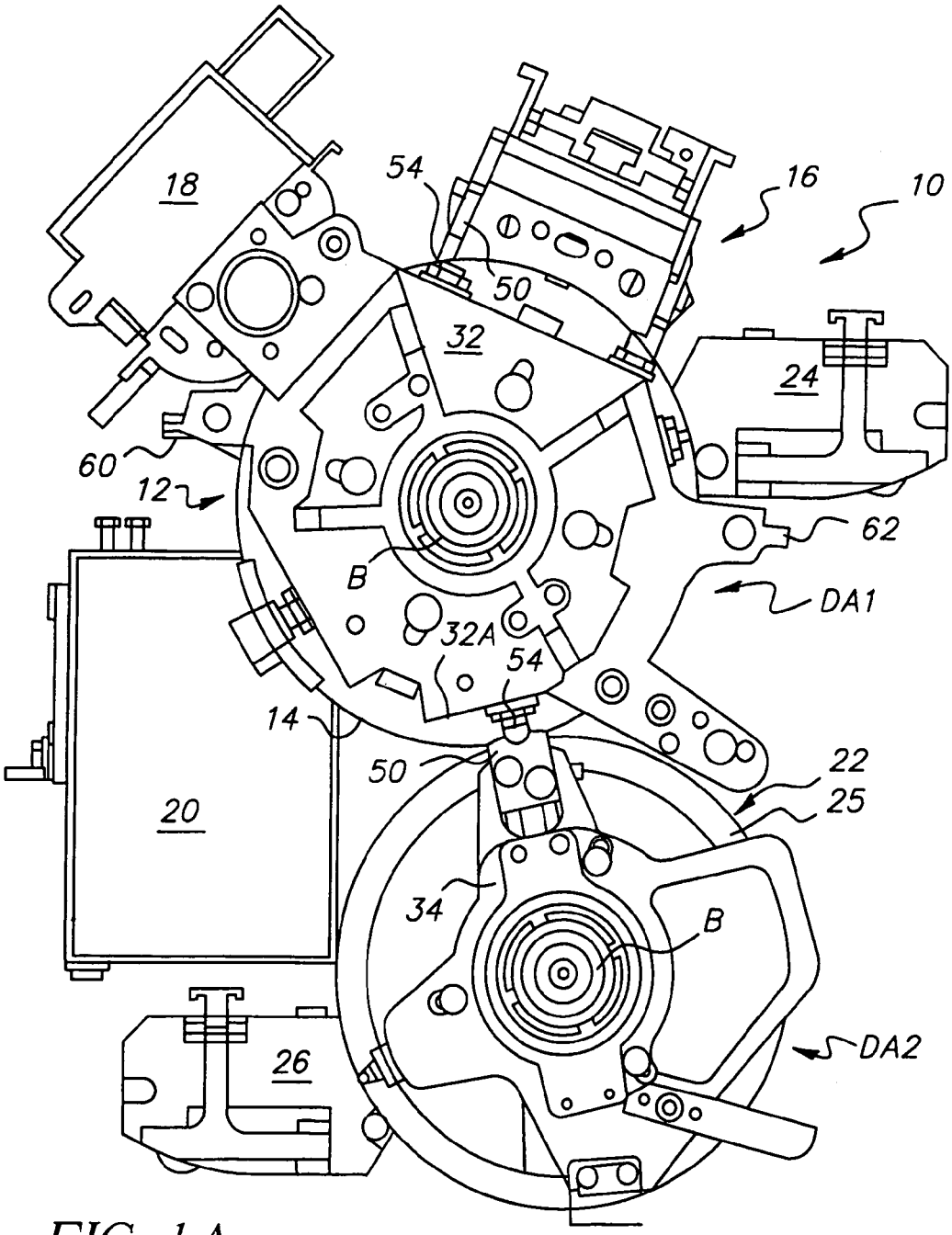
FIG. 1A (PRIOR ART)
FIG. 1A is an end view of a portion of an exemplary electrophotographic printer embodying drum-support and spacing adjustment members of the prior art.

Referring now to the drawings, FIG. 1A schematically illustrates a portion of an exemplary electrophotographic printer 10 of the prior art. As shown, printer 10 includes a pair of drum assemblies, DA1, DA2. Drum assembly DA1 includes an image-recording drum 12 having a photoconductive outer layer 14 on which toner images are formed in a conventional manner. Drum assembly DA2 includes an intermediate image-transfer drum 22 having an abhesive (non-stick) surface 25 to which toner images formed on the photoconductive outer surface of image-recording drum 12 are transferred prior to being re-transferred to a receiver sheet (not shown).

Briefly, toner images are formed on the photoconductive surface 14 of drum 12 by rotating the drum in the counter-clockwise direction (as viewed in FIG. 1A) past a series of work stations that sequentially operate on a desired portion of the drum's photoconductive outer surface. These work stations include a corona charging station 16 that serves to uniformly electrostatically charge the photoconductive surface, a solid-state print head 18 for imagewise exposing the charged photoconductive surface, line-by-line, to actinic radiation, thereby selectively dissipating the uniform charge and leaving behind a latent electrostatic charge image, and a development station 20 for developing the charge image with electroscopic toner particles. The toner image thus formed is then transferred to the outer surface 25 of the intermediate transfer drum 22, and residual toner on drum 12 is removed by a cleaning station 24. Upon transferring the toner image on the intermediate transfer drum 22 to an image-receiver sheet, the surface of drum 22 is cleaned by a second cleaning station 26.

Preferably, each work station is mounted for slight movement (e.g., about 5 to 7 mm) towards and away from its respective operative position adjacent the surface 14 of the drum 12 (or surface 25 of the drum 22) to provide minimal clearance for installation and replacement of the drum assemblies. During such installation, the drum assemblies are moved substantially parallel to drum's respective axis of rotation, through an opening in the machine frame.

Figure 2A:
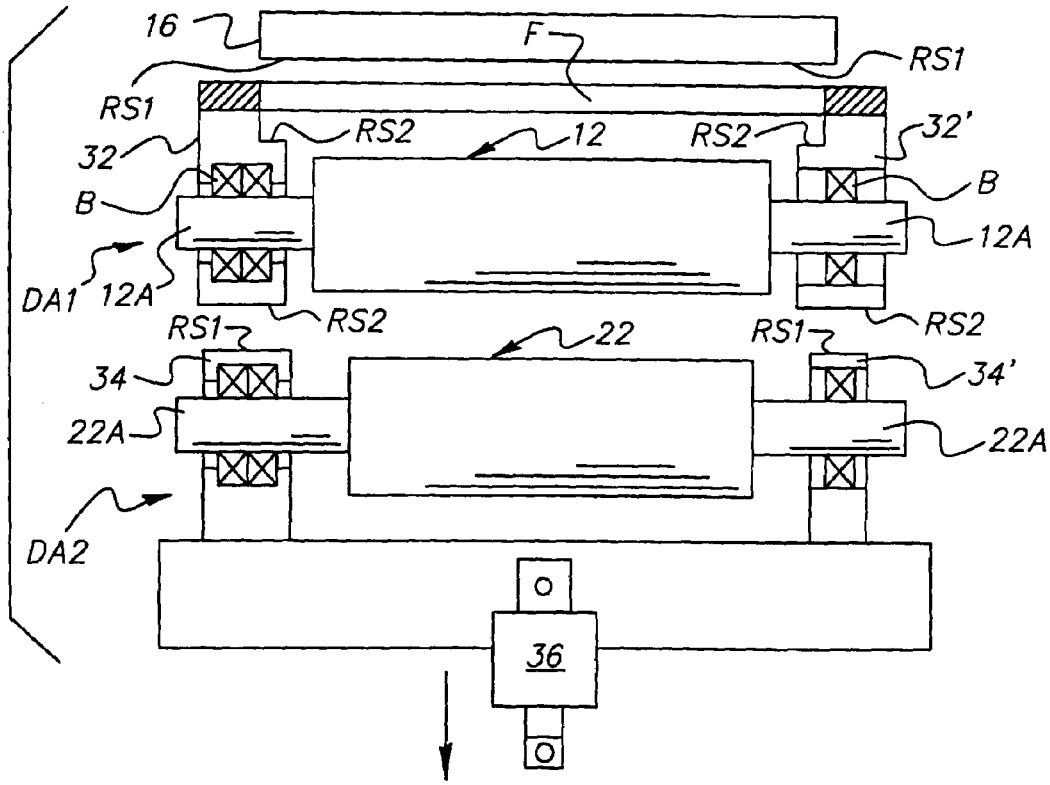
FIG. 2A (PRIOR ART)
FIGS. 2A and 2B are schematic front views of a portion of an apparatus similar to that shown in FIG. 1A, respectively in different relative positions of the photoconductor drum and image-transfer drum.
Figure 2B:
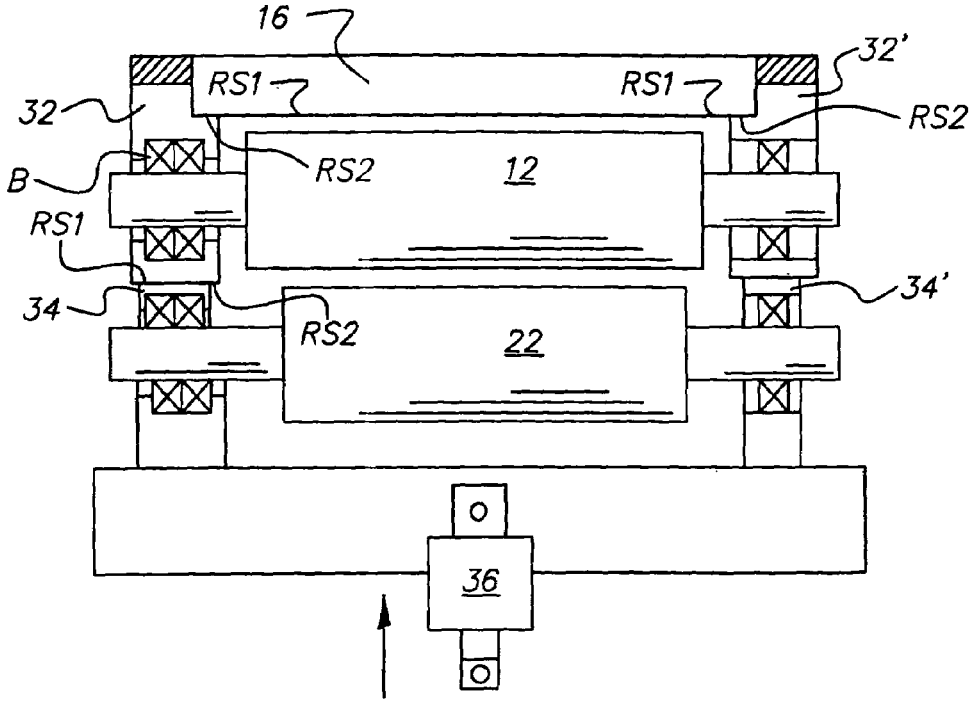
FIG. 2B (PRIOR ART)

Apparatus is provided for precisely and repeatedly positioning the various work stations of a document printer/copier, of the type described above relative to the outer surfaces of an image-recording drum 12 and/or an intermediate transfer drum 22 to enable, for example, removal, servicing and replacement of the individual work stations and/or drum(s) without altering a desired positional relationship between the work stations and drum(s). Referring additionally to the schematic illustrations of FIGS. 2A and 2B, such apparatus includes a pair of drum-support members 32, 32' and 34, 34', each of such members having a centrally located bearing B or the like for rotatably supporting a drum axle 12A extending outwardly from an end of drum 12. The drum-support members, in turn, are supported in a predetermined position within the printer frame F, as described in U.S. Pat. No. 6,295,427 to Flick, et. al., and hereby incorporated in its entirety by reference.

Each drum-support member 32, 32' and 34, 34' is provided with a plurality of reference surface features RS2 which cooperate with complimentary reference surface features RS1, carried by the respective work stations, to precisely position the work stations relative to the outer surface of the drum. (Note, the drum-support members 34, 34' of drum assembly DA2 has both types of reference surface features, RS1 and RS2, since DA2 is both a work station, i.e., an image transfer station that operates on drum 12 to transfer a toner image, and a drum on which processing is effected, i.e., by the cleaning station 26.) Thus, as the work stations are moved from their respective stand-by or loading positions toward their operative positions, the reference surface features RS1 of the work stations move into contact with and engage the reference surface features RS2 on the drum-support members to locate each work station in a desired position relative to the drum surface.

Figure 1B:
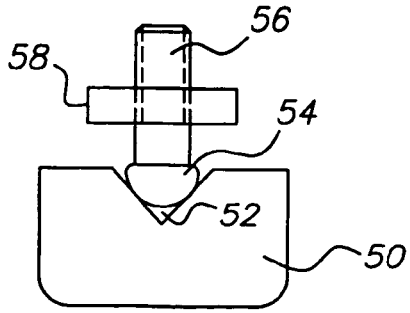
FIG. 1B (PRIOR ART)
FIG. 1B is an enlarged view of a detail of the spacing adjustment member portion of the apparatus shown in FIG. 1A.

The reference surface features RS1 of most of the work stations take the form of a block 50 (specifically shown in FIG. 1B) having a V-groove 52 for receiving a bullet-shaped locator 54 disposed at the distal end of a threaded member 56. Member 56 is threaded into a threaded hole bored in an outer surface of the drum-support members 32, 32', and the height of the locator 54 above its supporting surface (e.g., surface 32A) is adjustable by rotating and setting a nut 58 threaded on member 56.

Figure 3A:
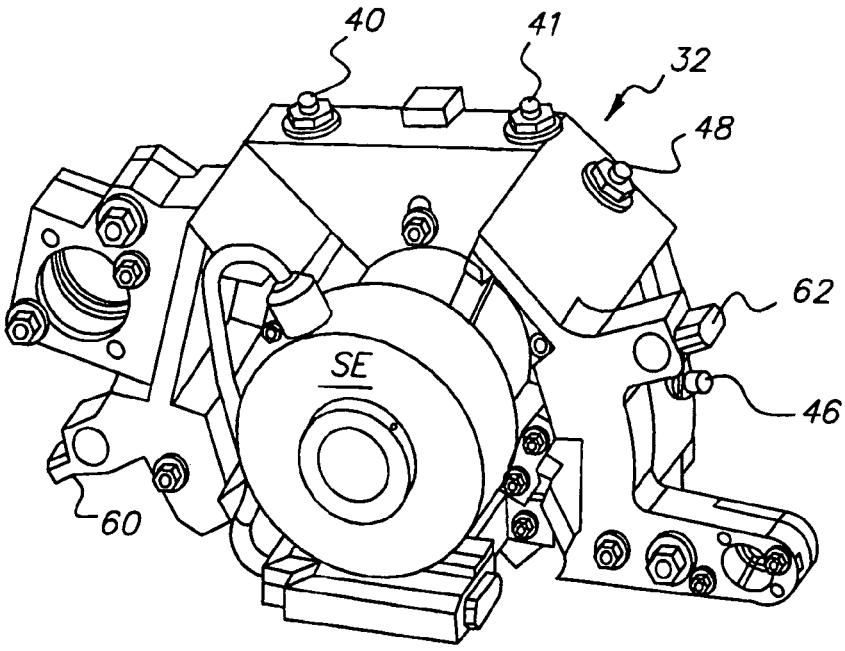
(PRIOR ART) FIG. 3A
FIGS. 3A and 3B are front isometric views of prior art drum-support members for supporting a photoconductive drum of the type used in the electrophotographic printer of FIG. 1A.
Figure 3B:
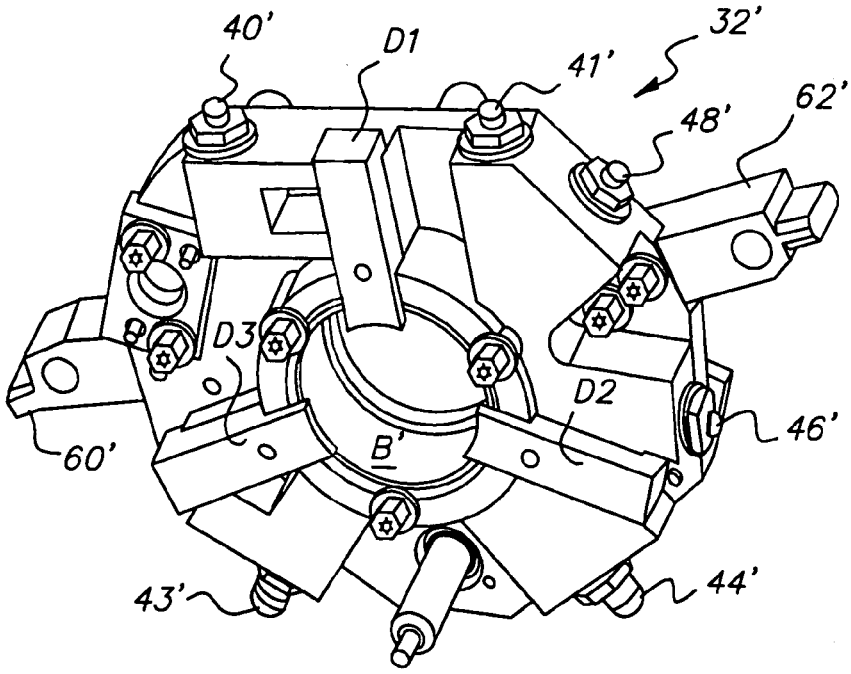
(PRIOR ART) FIG. 3B
Figure 4A:
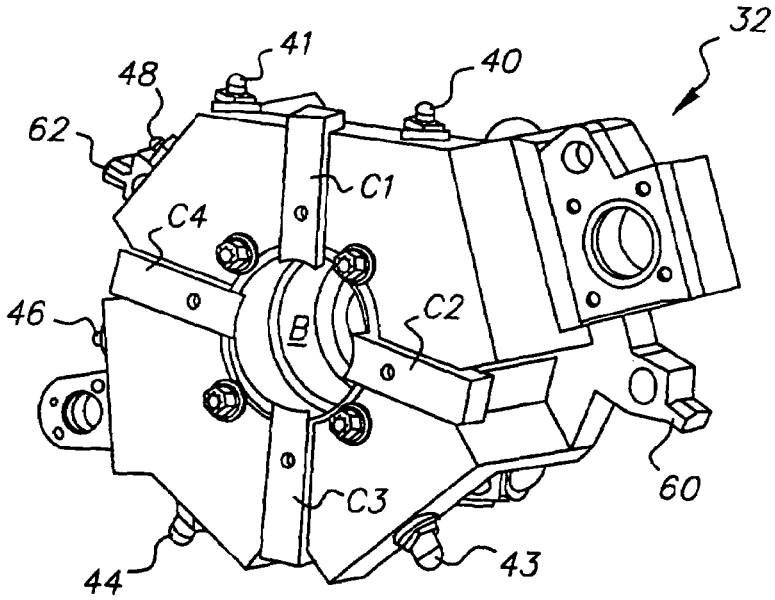
(PRIOR ART) FIG. 4A
FIGS. 4A and 4B are rear isometric views of the drum-support members shown in FIGS. 3A and 3B, respectively.
Figure 4B:
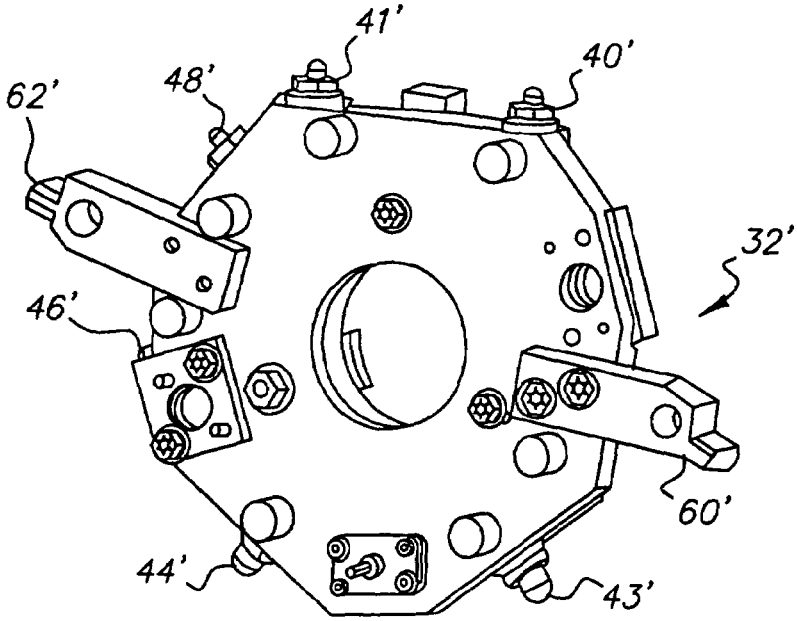
(PRIOR ART) FIG. 4B

FIGS. 3A and 3B are isometric front views of drum-support members 32 and 32', respectively, and FIGS. 4A and 4B are isometric rear views of the same drum-support members, respectively. Member 32 supports a shaft encoder SE through which the rotational speed of drum 12 is controlled. Member 32 further supports bullet-shaped reference features 40 and 41 which together with features 40' and 41' on drum-support member 32', serve to precisely position the operative component of the corona charging station 16, i.e., the corona discharge wire, substantially parallel to the surface of drum 12. Similarly, features 43 and 43' (shown in FIGS. 4A and 4B) serve to precisely position the operative component of the development station 20; features 44 and 44' serve to position the intermediate transfer drum 22; features 46 and 46' serve to position an optional pre-clean corona charger (forming part of cleaning station for drum 12); and features 48 and 48' serve to position the cleaning brush 24. Preferably, each of the drum-support members 32, 32' further comprises a pair of drum-support legs 60, 62; 60, 62' which, as explained in the aforementioned U.S. Pat. No. 6,295,427, are slidably received in a pair of spaced parallel channels located within the printer frame for supporting the drum assembly in a desired position within the printer. Four clamps C1–C4 serve to retain the bearing B used to rotatably support one of the drum axles A in member 32, and three additional clamps D1–D3 serve to retain the bearing B' used to rotatably support the other drum axle in member 32'.

Figure 5:
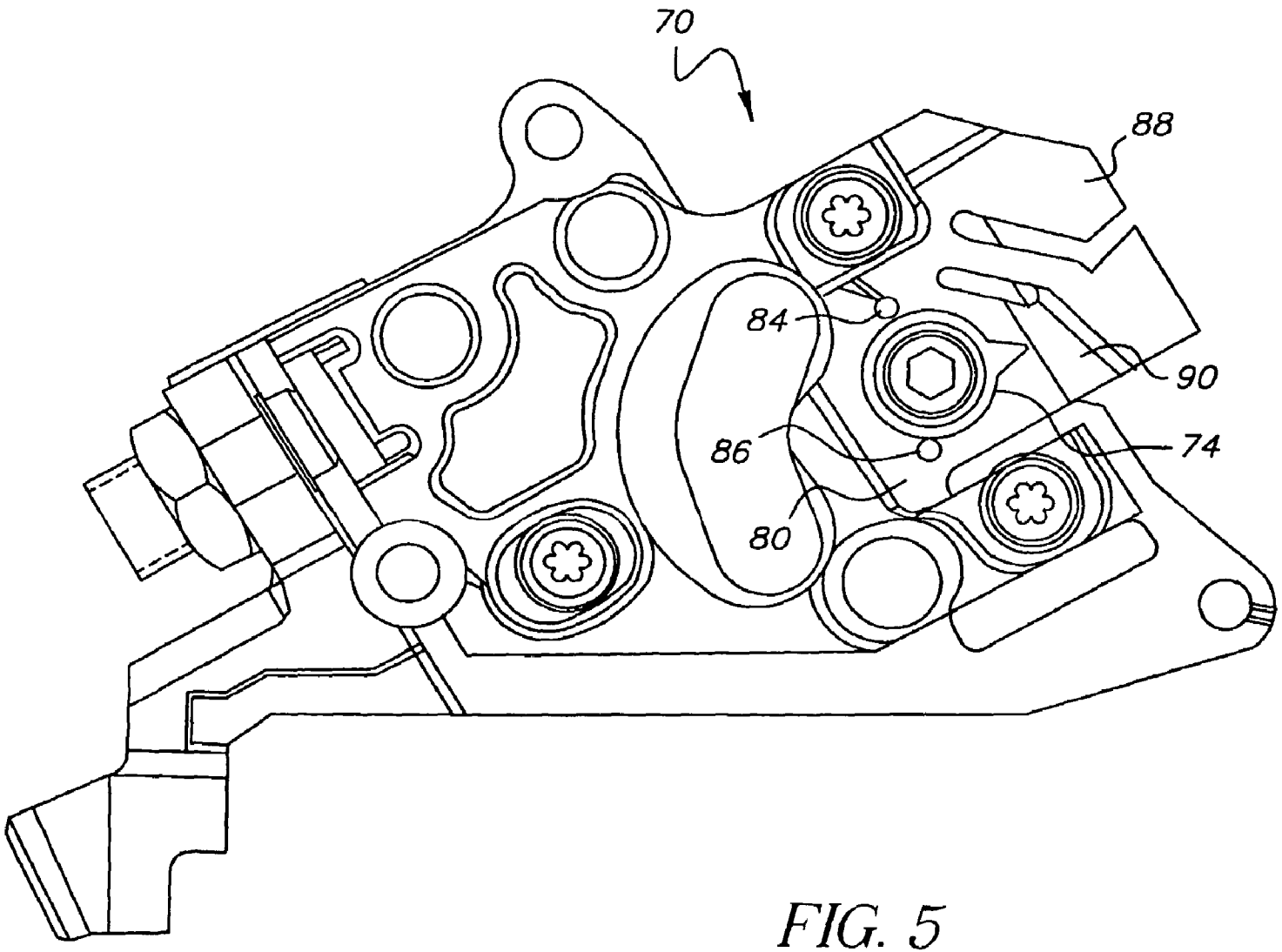
FIG. 5 is a side elevation view of the spacing adjustment member for adjustment of work station position relative to the drums, according to this invention.
Figure 6:
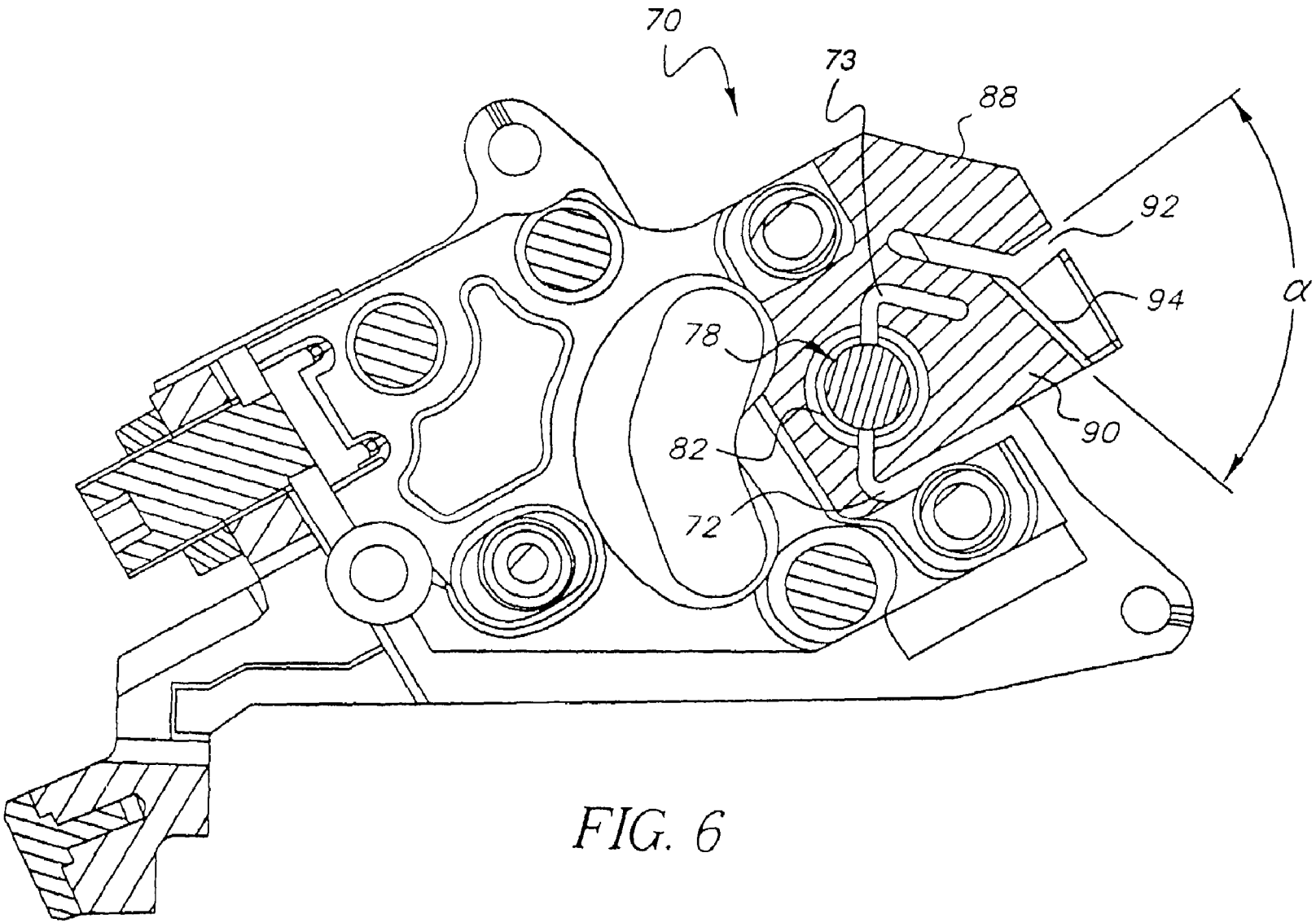
FIG. 6 is a view, partially in cross section, of the grooved member in FIG. 5 taken along the lines 6—6 of FIG. 7.
Figure 7:
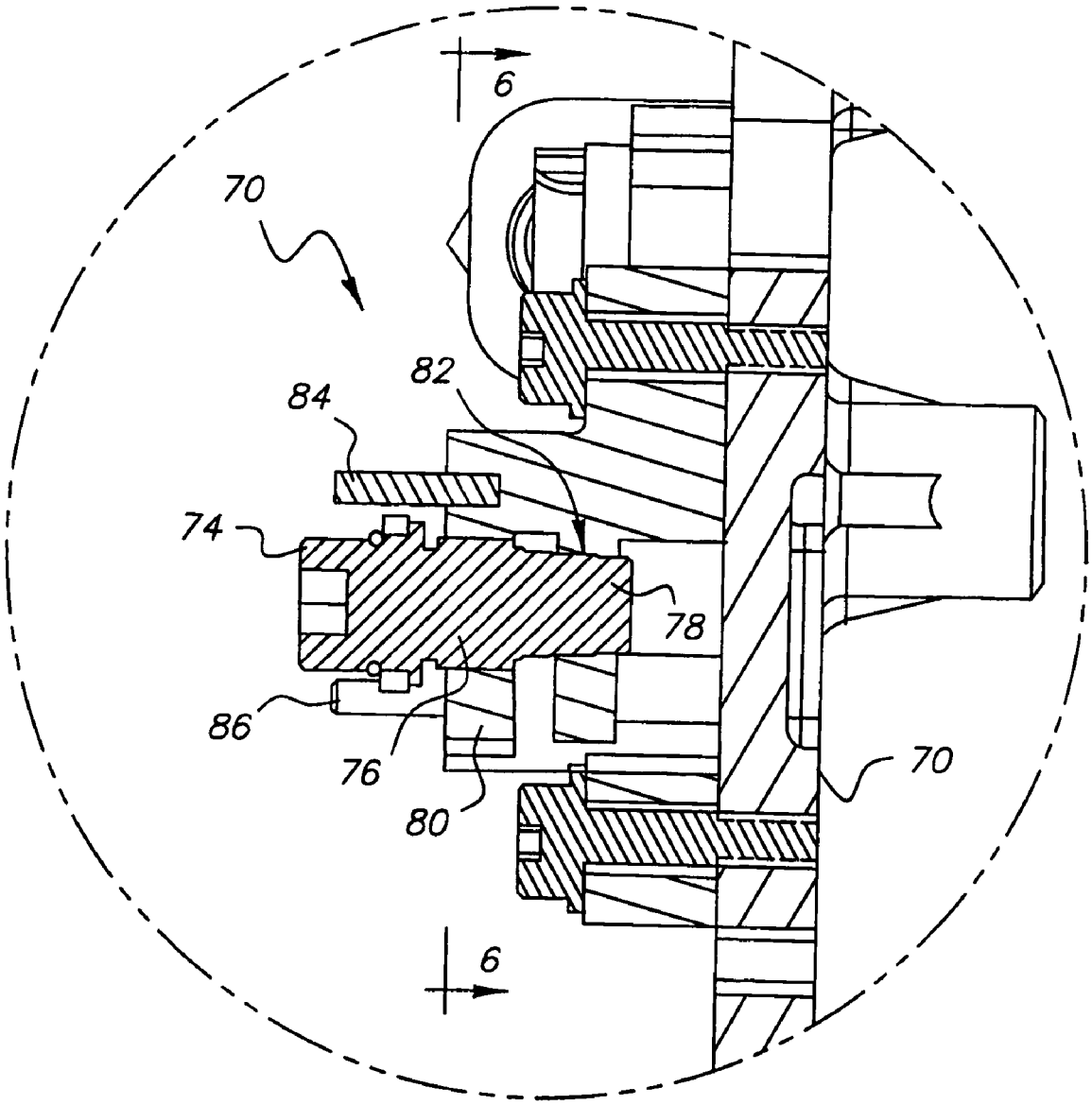
FIG. 7 is a front elevation view, in cross section, of the portion of the grooved member with the adjusting screw.

FIG. 5 is a side elevational view of the spacing adjustment member 70 of the present invention, which enables precise adjustment of the work stations relative to the drum DA1 (or DA2) at the user site. FIG. 6 is the same elevational view as FIG. 5 but in partial cross section so as to more clearly show the regulating groove 72, of the spacing adjustment member 70, and to more clearly describe how adjustment with such spacing adjustment member is made. FIG. 7 is a front elevational cross sectioned view showing the threaded part 76 and tapered end 78 of an adjustment screw 74. The head of the adjustment screw 74 is seen in FIG. 5. Adjustment screw 74 is threaded into wall 80 of the spacing adjustment member 70 and tapered end 78 mates into tapered hole 82 in the regulating groove 72. Two limit pins 84 and 86, seen in FIG. 5, protrude from wall 80 and limit the rotation of adjusting screw 74 to approximately 180°. Referring again to FIG. 6, the regulating groove 72 and flexure groove 73, cooperate to define two sections 88 and 90 for the spacing adjustment member 70, each section having a reference surface 92 and 94 respectively. The grooves 72 and 73 enable the sections 88 and 90 to move relative to one another.

In FIG. 6, reference surfaces 92 and 94 are oriented at an angle $\alpha$ to each other. When the spacing adjustment member 70 is attached to the end of a work station of the document printer/copier described above, reference surfaces 92 and 94 form a V-groove corresponding to the V-groove 52 illustrated in FIG. 1B, to interface with the appropriate bullet-shaped locator 54 of either drum assembly DA1 or DA2. There, if adjustment screw 74 is turned clockwise, tapered end 78 is advanced into tapered hole 82, forcing groove 72 to open wider as a result of flexure of section 88 relative to section 90, thereby decreasing angle $\alpha$ between reference surfaces 92 and 94. Accordingly when the appropriate bullet-shaped locator 54 nests between the repositioned surfaces 92 and 94, the spacing between work station and drum will have been increased. Similarly, when adjusting screw 74 is turned counterclockwise, tapered end 78 is retracted from tapered hole 82 enabling sections 88 and 90 to move relative to one another such that angle $\alpha$ increases. Thus, when the locator 54 engages the repositioned surfaces 92 and 94, the spacing between the work station and drum is decreased.

Figure 8:
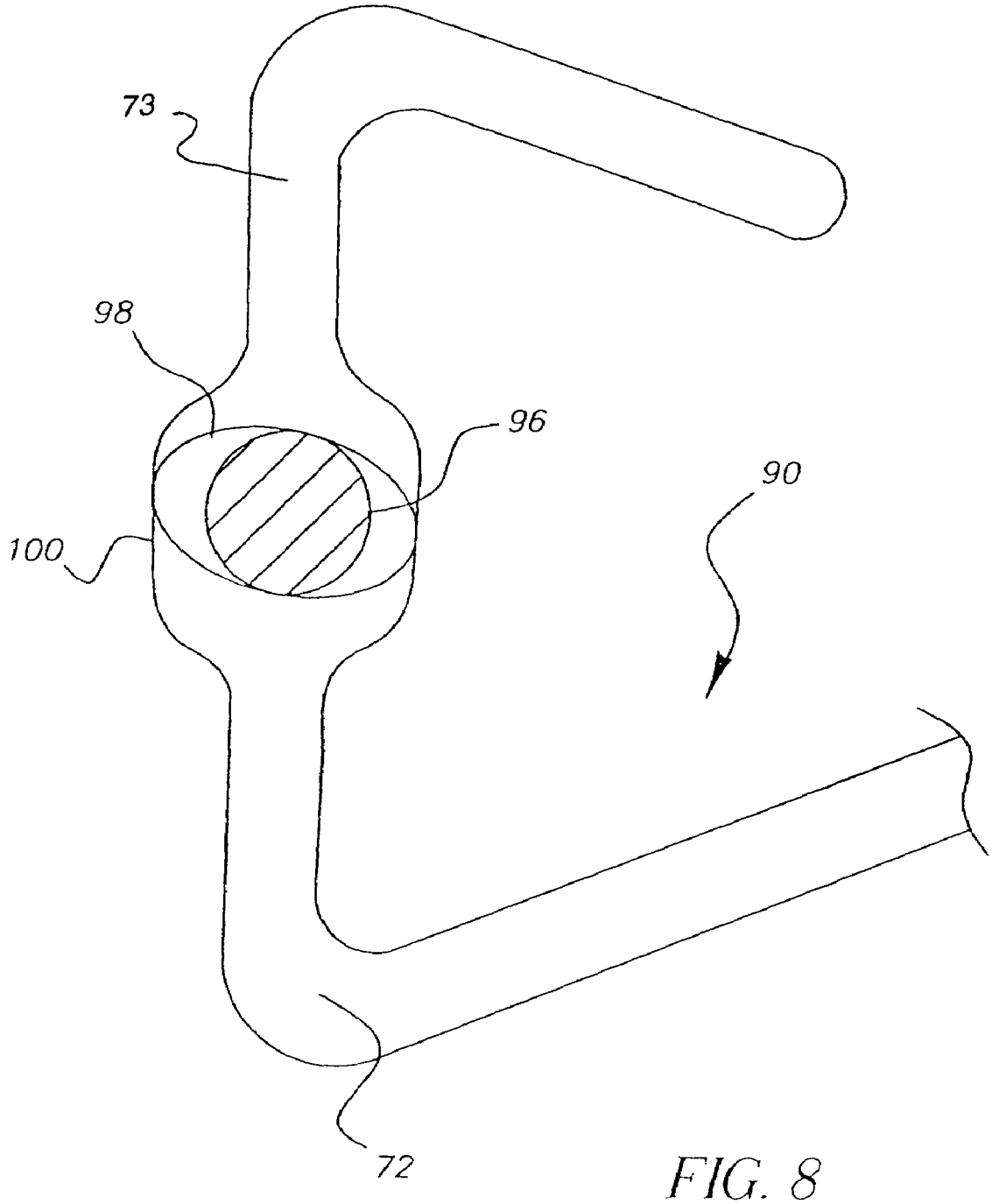
FIG. 8 is similar to FIG. 6, but shows an alternate embodiment of the invention in which the adjusting screw in FIG. 6 is replaced by a cam-shaped member.

In an alternative embodiment of the adjustment apparatus embodied in the spacing adjustment member 70 described above (and illustrated in FIGS. 5–7), a cam-shaped member 98 may be used to selectively expand or contract the regulating groove 72, instead of adjustment screw 74, with threaded part 76 and tapered end 78. This alternative embodiment is illustrated in FIG. 8. In this alternative embodiment, a screw-like member 96, with a distal cam-shaped end 98 replaces adjustment screw 74. The cam-shaped end 98 is located within an expanded section 100 of the regulating groove 72, such that groove 72 is selectively expanded or contracted by action of the cam-shaped end 98 on the walls of the expanded section 100 as screw-like member 96 is rotatably turned. The head of screw-like member 96 in this embodiment is identical to the head of adjustment screw 74 in the previous embodiment illustrated in FIGS. 5–7, so FIG. 5 applies to this alternative embodiment also. However, for this alternative embodiment, the cross-section view corresponding to FIG. 6 is shown in FIG. 8 in which is shown the cam-shaped end 98 of screw-like member 96 located in the expanded section 100 of groove 72.

In one exemplary embodiment, the adjustment apparatus embodied in the spacing adjustment member 70 described above and illustrated in FIGS. 5–7 (or FIG. 8), is used to adjust the spacing between the operative component of developer station 20, namely a magnetic brush roller, and image-recording drum 12 in the electrophotographic printer 10 illustrated in FIG. 1A. With the spacing adjustment member 70 attached to the housing of development station 20, such spacing is initially set with the adjustment screw 74 positioned, for example, substantially midway between the two limit pins 84 and 86 (as is shown in FIG. 5). A test print is then produced by the electrophotographic printer 10 and the density of the toner image on the test print is measured with an optical densitometer, and compared to a predetermined target density. If the measured toner density on the test print is less than the target density, such an error is an indication that the spacing between the operative component of developer station 20, namely a magnetic brush roller, and image-recording drum 12 is too large. The adjustment screw 74 is then turned counter-clockwise to decrease the spacing between the magnetic brush roller and the image-recording drum 12 as described above. If the measured toner density on the test print is greater than the target density, such an error is an indication that the spacing between the operative component of developer station 20, namely a magnetic brush roller, and the image-recording drum 12 is too small. The adjustment screw 74 is then turned clockwise to increase the spacing between the magnetic brush roller and the image-recording drum 12 as described above. This test printing process is iterated until the toner density on the test print is on target.

In another exemplary embodiment, the adjustment apparatus described above is used to adjust the spacing between the corona charging station 16 and the image-recording drum 12 in the electrophotographic printer 10 illustrated in FIG. 1A. It is well known to include an electrostatic voltmeter (not shown in FIG. 1A) in electrophotographic printers of the type illustrated in FIG. 1A to measure the electrostatic surface potential created by the electrostatic charge deposited by corona charging station onto photoconductive surface 14 of image-recording drum 12. With spacing adjustment member 70 attached to the housing of corona charging station 16, the surface potential created on photoconductive surface 14 by corona charging station 16, is measured with the electrostatic voltmeter while producing a test print. The measured surface potential is compared to a predetermined target surface potential. If the measured surface potential is less than the target surface potential, such an error is an indication that the spacing between the operative component of corona charging station 16, namely the high voltage corona wires, and image-recording drum 12 is too large. The adjustment screw 74 is then turned counterclockwise to decrease the spacing between the high voltage wires and the image-recording drum 12. If the measured surface potential is greater than the target surface potential, such an error is an indication that the spacing between the operative component of corona charging station 16, namely the high voltage corona wires, and the image-recording drum 12 is too small. The adjustment screw 74 is then turned clockwise to increase the spacing between the high voltage corona wires and the image-recording drum 12. This test printing process is iterated until the measured surface potential is on target.

It should be clear that the above described apparatus can also be used with the other work stations of electrophotographic printer 10, namely print head 18, image-transfer drum 22, and cleaning stations 24 and 26.

While the invention has been described with reference to exemplary embodiments, it will be appreciated that variations can be made without departing from the spirit of the invention, and such variations are intended to fall within the scope of the appended claims.

What is claimed is:

1. Apparatus for precisely adjusting the position of a work station relative to a work piece, said adjusting apparatus comprising:

a first member, attached at a predetermined position with respect to either of said work station or said work piece, said member having first and second relatively movable sections, said first section having a first section surface and said second section having a second section surface at an angle to said first section surface;

a second member, attached at a predetermined position with respect to the other of said work station or said work piece, said second member having a reference surface thereon, said reference surface being positioned to engage said first section surface and said second section surface to position said work station relative to said work piece; and an actuator for changing the angular position of said first section surface relative to said second section surface, whereby when said reference surface engages said first and second section surfaces, the position of said work piece relative to said work station is accurately adjusted.

2. The apparatus as defined by claim 1, wherein a tapered hole is defined in said first member between said first section and said second section thereof, said actuator comprises a screw with a non-threaded tapered end, and means for selectively advancing or retracting said screw into or out of said tapered hole to change the angle between said first section and said second section.

3. The apparatus as defined by claim 1, wherein said actuator comprises a cam-shaped member, and means for selectively rotating said cam-shaped member within said first member between said first section and said second section to change the angle between said first section and said second section.

4. The apparatus as defined by claim 1, wherein said first section surface and said second section surfaces are planer and angularly positioned relative to one another, and said second member reference surface is hemispherically shaped.

5. The apparatus as defined by claim 4, wherein a tapered hole is defined in said first member between said first section and said second section thereof, said actuator comprises a screw with a non-threaded tapered end, and means for selectively advancing or retracting said screw into or out of said tapered hole to change the angle between said first section and said second section.

6. The apparatus as defined by claim 4, wherein said actuator comprises a cam-shaped member, and means for selectively rotating said cam-shaped member within said first member between said first section and said second section to change the angle between said first section and said second section.

7. The apparatus as defined by claim 4, wherein said first member defines a groove between said first section and said second section, said groove enabling said first section to move relative to said second section in a manner to change the relative angle therebetween.

8. Apparatus for precisely adjusting the position of a work station relative to a work piece, said work station including a housing containing an operative component adapted to effect a process to be carried out upon said work piece, said apparatus comprising:

a member, attached to said housing at a predetermined position with respect to the operative component of said workstation, having a groove defining first and second sections of said member on opposite sides of said groove, said first section having a first section surface and said second section having a second section surface positioned relative to said first section surface;

at least one work piece support member, having a work station-positioning reference surface thereon, said work station-positioning reference surface being positioned to engage said first section surface and said second section surface to position said operative component of said work station relative to said work piece;

an actuator for selectively expanding or contracting the width of said groove, thereby changing the position of said first section surface relative to said second section surface, whereby when said work station-positioning reference surface engages said first and second section surfaces the position of said operative component relative to said work piece is accurately adjusted.

9. The apparatus as defined by claim 8, wherein said actuator comprises a screw with a non-threaded tapered end, and means for selectively advancing or retracting said screw into or out of a tapered hole defined in said groove.

10. The apparatus as defined by claim 8, wherein said actuator comprises a cam-shaped member, and means for selectively rotating said cam-shaped member within said groove.

11. The apparatus as defined by claim 8, wherein said first section surface and said second section surfaces are planer and angularly positioned relative to one another, and said work station-positioning reference surface is hemispherically shaped.

12. The apparatus as defined by claim 11, wherein said actuator comprises a screw with a non-threaded tapered end, and means for selectively advancing or retracting said screw into or out of a tapered hole defined in said groove.

13. The apparatus as defined by claim 11, wherein said actuator comprises a cam-shaped member, and means for selectively rotating said cam-shaped member within said groove.

14. Apparatus for precisely adjusting the position of a work station relative to the surface of a rotating drum, said work station comprising a housing containing an elongated operative component extending along a longitudinal axis and adapted to effect a process to be carried out upon the surface of said drum, said apparatus comprising:

a member, attached to said housing at a predetermined position with respect to the operative component of said workstation, having a groove defining first and second sections of said member on opposite sides of said groove, said first section having a first section surface and said second section having a second section surface positioned relative to said first section surface;

a pair of drum-support members, each having a centrally located bearing adapted to receive and rotatably support one end of said drum relative to a longitudinal axis of said bearing, at least one of which drum-support members having a work station-positioning reference surface thereon, said work station-positioning reference surface being positioned to engage said first section surface and said second section surface to position said operative component of said work station relative to the surface of said drum; and an actuator for selectively expanding or contracting the width of said groove, thereby changing the relative position of said first section surface and second section surface, whereby when said work station-positioning reference surface engages said first and second section surfaces the position of said operative component relative to said work piece is accurately adjusted.

15. The apparatus as defined by claim 14, wherein said actuator comprises a screw with a non-threaded tapered end, and means for selectively advancing or retracting said screw into or out of a tapered hole defined in said groove.

16. The apparatus as defined by claim 14, wherein said actuator comprises a cam-shaped member, and means for selectively rotating said cam-shaped member within said groove.

17. The apparatus as defined by claim 14, wherein said first section surface and said second section surfaces are planer and angularly positioned relative to one another, and said work station-positioning reference surface is hemispherically shaped.

18. The apparatus as defined by claim 17, wherein said actuator comprises a screw with a non-threaded tapered end, and means for selectively advancing or retracting said screw into or out of a tapered hole defined in said groove.

19. The apparatus as defined by claim 17, wherein said actuator comprises a cam-shaped member, and-means for selectively rotating said cam-shaped member within said groove.

20. The apparatus as defined by claim 14, wherein the surface of said drum is coated with a photoconductive member and said operative element is at least one of the devices which includes means for forming a transferable toner image on said photoconductive member.

21. The apparatus as defined by claim 20, wherein said actuator comprises a screw with a non-threaded tapered end, and means for selectively advancing or retracting said screw into or out of a tapered hole defined in said groove.

22. The apparatus as defined by claim 20, wherein said actuator comprises a cam-shaped member, and means for selectively rotating said cam-shaped member within said groove.

23. The apparatus as defined by claim 20, wherein said first section surface and said second section surface are planer and angularly positioned relative to one another, and said work station-positioning reference surface is hemispherically shaped.

24. The apparatus as defined by claim 23, wherein said actuator comprises a screw with a non-threaded tapered end, and means for selectively advancing or retracting said screw into or out of a tapered hole defined in said groove.

25. The apparatus as defined by claim 23, wherein said actuator comprises a cam-shaped member, and means for selectively rotating said cam-shaped member within said groove.

* * * * *